US007077196B2

(12) United States Patent
Rudd

(10) Patent No.: US 7,077,196 B2
(45) Date of Patent: Jul. 18, 2006

(54) EXPANDABLE DOWNHOLE TUBULAR AND METHOD OF USE

(75) Inventor: Wayne Rudd, Newcastle upon Tyne (GB)

(73) Assignee: Weatherford/Lamb, Inc., Houston, TX (US)

( * ) Notice: Subject to any disclaimer, the term of this patent is extended or adjusted under 35 U.S.C. 154(b) by 73 days.

(21) Appl. No.: 10/423,835

(22) Filed: Apr. 25, 2003

(65) Prior Publication Data

US 2004/0003927 A1 Jan. 8, 2004

(30) Foreign Application Priority Data

Apr. 25, 2002 (GB) ..... 0209472.0

(51) Int. Cl.
*E21B 43/10* (2006.01)

(52) U.S. Cl. ..... 166/207; 166/227; 166/236; 166/384

(58) Field of Classification Search ..... 166/207, 166/384, 227, 236, 226
See application file for complete search history.

(56) References Cited

U.S. PATENT DOCUMENTS

| | | | | |
|---|---|---|---|---|
| 1,880,218 | A | 10/1932 | Simmons | |
| 2,812,025 | A * | 11/1957 | Teague et al. | 166/207 |
| 5,901,789 | A | 5/1999 | Donnelly et al. | |
| 6,012,522 | A * | 1/2000 | Donnelly et al. | 166/276 |
| 6,098,717 | A * | 8/2000 | Bailey et al. | 166/382 |
| 6,457,532 | B1 | 10/2002 | Simpson | |
| 6,695,054 | B1 * | 2/2004 | Johnson et al. | 166/278 |
| 2002/0092649 | A1 * | 7/2002 | Bixenman et al. | 166/278 |

FOREIGN PATENT DOCUMENTS

| | | |
|---|---|---|
| EP | 0 952 305 | 10/1999 |
| EP | 1 152 120 A2 | 11/2001 |
| WO | 97/17524 | 5/1997 |
| WO | WO 99/02818 | 1/1999 |
| WO | 00/37766 | 6/2000 |

* cited by examiner

*Primary Examiner*—David Bagnell
*Assistant Examiner*—Giovanna M Collins
(74) *Attorney, Agent, or Firm*—Patterson & Sheridan, L.L.P.

(57) ABSTRACT

There is disclosed, in one embodiment of the invention an expandable downhole tubular (10) comprising an expandable inner support tube (14) an expandable outer tube (18); and a filter tube (22) located between said inner support tube (14) and said outer tube (18), the filter tube (22) comprising at least one filter portion (24) and at least one extendable portion (28) coupling axial edges of said filter portion (24), said extendable portion (28) being extendable to accommodate circumferential expansion of said filter tube (22).

44 Claims, 2 Drawing Sheets

EXPANDABLE DOWNHOLE TUBULAR AND METHOD OF USE

BACKGROUND OF THE INVENTION

1. Field of the Invention

This invention relates to an expandable downhole tubular. Particularly, but not exclusively, the present invention relates to an expandable downhole tubular including a filter for removing solid particles from well fluid downhole.

2. Description of the Related Art

In the oil and gas exploration and production industry, boreholes are drilled into hydrocarbon bearing formations to recover well fluids. In well bores where a liquid, for example, oil, passes from a surrounding formation into the well bore, the liquid will often carry entrained sand particles. If this sand is permitted to pass into the well bore a number of problems may arise, including an increased likelihood of the well bore becoming blocked or restricted, and the sand may cause downhole tools to stick or jam, or wear prematurely. Accordingly, it is preferred that the sand particles are retained in the formation. This is achieved by providing screens or a filter around the casing or production tubing.

International patent publication No. WO97/17524(Shell) discloses a radially expandable assembly in which overlapping filter sheets are sandwiched between inner expandable support tubing and outer expandable protective tubing, the expandable tubing featuring large numbers of overlapping longitudinal slots. Typically, four filter sheets are provided and are welded to the inner support tubing along an axis of each sheet, and the sheets overlap in a circumferential direction. When an expansion tool is forced through the assembly, the inner and outer tubing is expanded radially, the slots extending to form diamond-shaped openings. The initial degree of overlap between the screens is selected such that, although the screens move circumferentially relative to one another during expansion, the edges of the screens remain in overlapping relation.

Whilst the performance of such assemblies in the downhole environment has been shown to be effective, assemblies including such tubing are difficult and time-consuming to manufacture, increasing the cost of the end product.

An alternative sandscreen assembly incorporates a filter sheet comprising a woven mesh strip helically wound onto an inner support tubing and secured to the inner tubing by welding along the warp wires, which define the edges of the strip. A tubular mesh is thus formed around the entire circumference of the inner support tubing.

When the assembly is expanded, the filter screen expands circumferentially by relative rotation of the warp and weft wires. Like the assembly of the Shell disclosure, it is believed the welding required to secure the filter screen to the inner support tube will be time-consuming and expensive.

European patent publication No. EP1152120 (Halliburton Energy Services, Inc) discloses an expandable well screen, which, in one embodiment, comprises a base pipe with interconnected circumferentially alternating filtering portions and expansion portions outwardly overlying the base pipe. The filtering portions each include an elongated strip of filtering media and a shroud strip overlying the filtering media. The expansion portions are of a deformable material and include longitudinally extending corrugations. The expansion portions lengthen circumferentially relative to the base pipe on expansion by opening out of the corrugations.

The well screen of EP1152120 is a complex assembly incorporating a range of components having different material properties, and expansion of the base pipe will cause a permanent plastic deformation of the expansion portions. In use, there will be a degree of elastic recovery of the well screen post expansion. However, if elastic recovery of the expansion portions is less than that of the base pipe, this will tend to cause a separation between the expansion/filtering portions and the base pipe post expansion, which is generally undesired. Additionally, if there is no connection between the expansion/filtering portions and the base tube, the likelihood of separation post expansion is increased.

Furthermore, the expansion portions, which are a critical part of the well screen, are provided radially outwardly of the base pipe and are unprotected and thus liable to be damaged, for example, through contact with a borehole wall during run-in and prior to expansion.

Also, manufacture of the well screen will be complicated by the requirement to avoid plastically deforming the expansion portions during fitting of the expansion/filtering portions to the base pipe.

SUMMARY OF THE INVENTION

It is amongst the objects of embodiments of the present invention to provide an expandable downhole tubular which is more economic to manufacture than conventional assemblies whilst maintaining or improving operational performance.

According to an aspect of the present invention, there is provided an expandable downhole tubular comprising:

an expandable inner support tube;

an expandable outer tube; and a filter tube located between said inner support tube and said outer tube, the filter tube comprising at least one filter portion and at least one extendable portion coupling axial edges of said filter portion, said extendable portion being extendable to accommodate circumferential expansion of said filter tube.

This provides an expandable downhole tubular including a filter where expansion may be accommodated without or with minimal extension of the filter portion. Thus characteristics of the filter portion, such as mesh dimensions and filter performance, are maintained. Embodiments of the present invention have the particular advantage over prior art arrangements in that they are quicker, easier and less expensive to manufacture without any reduction in operational capabilities.

The filter tube may be for filtering solid particles from well fluids recovered through said outer tube. Such particles may include fine sands and other granular solids therefore the tubular may in particular comprise a sandscreen. The expandable inner and outer tubes may be perforated or formed with other flow ports or passages. Preferably, one or both of the inner and outer tubes comprise a plurality of axially extending slots, circumferentially adjacent slots being axially offset. Slots of this type extend to form diamond-shaped openings on expansion of the tube.

The expandable inner support tube may include threaded connections such as pin and box connections for connecting the downhole tubular to adjacent tubulars.

Preferably, the filter tube comprises at least one filter member defining the filter portion and at least one separate extendable member defining the extendable portion and coupled between axial edges of said filter member. Most preferably, the filter tube comprises a plurality of filter members and a plurality of extendable members, each extendable member coupled between axial edges of an adjacent pair of filter members. Thus the filter tube may comprise a number of filter members coupled together by extendable members, to together define the tube. The filter tube may in particular comprise four filter members and four extendable members, each extendable member coupled between an adjacent pair of filter members. The filter portion may comprise a curved filter screen comprising perforated or laser-cut metal sheet, wire mesh or any other suitable structure. Preferably said filter portion has a higher yield strength than said extendable portion.

The filter portion may define more than 50%, preferably between 50% and 75% or more of a total surface area of the filter tube prior to expansion thereof. Also, the filter portion, although defining a lower percentage of the total surface area of the filter tube post expansion (due to extension of the extendable portion) may still define at least 50%, preferably more, for example 60 or 70%, of the total surface area of the filter tube. It will be understood that where the tubular comprises a plurality of filter portions, the filter portions may together define such a surface area of the filter tube.

Preferably, the extendable portion comprises an elastic member, such as an elastomer or a rubber material. Providing an extendable portion, which is of an elastic material such as an elastomer, offers particular advantages over prior assemblies. For example, elastic recovery of a filter tube including an elastic extendable portion ensures that elastic recovery of the filter tube post expansion will be greater than that of the inner support tube. This will ensure that the filter tube remains in close contact with the inner tube even after expansion. Furthermore, the downhole tubular is less complex and easier to manufacture compared to prior assemblies. This is because the elastic extendable portion allows the filter tube to be elastically deformed to a larger diameter for location around the inner tube, the elastic extendable portion subsequently contracting to form a close fit of the filter tube on the inner tube, as will be described in more detail below. Alternatively, the extendable portion may comprise an alternative plastics material; an elastic woven screen of an elastomer or other plastics material; a metal material such as a metal mesh; or any other suitable material. Alternatively, the extendable member may comprise a plastically deformable material, such as an alternative plastics or metal material. The extendable member may be mechanically coupled, sintered, welded or otherwise secured to the filter member. Alternatively, the filter tube may comprise a one-piece member and the extendable portion may comprise a portion of lower yield strength than the filter portion.

In an alternative embodiment, the circumferential extension of the extendable member may be at least partially accommodated by a change in the form of the member, rather than solely by physical extension of the material of the member. For example, the extendable member may initially have a corrugated or folded configuration, permitting circumferential extension by flattening or unfolding. Of course, the extension of the member may be accommodated through any combination of mechanisms.

Conveniently, the filter tube is secured to at least one of said inner and outer tubes to locate the filter tube in the tubular. The filter tube may be secured by connecting said extendable member to said inner/outer tube, for example, by spot welding or sintering. The extendable portion may be welded along a central axis, or an axial edge thereof. This ensures that the filter tube is securely located relative to the inner/outer tube and offers advantages over prior assemblies where filters may not be securely located. The outer tube may be coupled to the inner tube, for example, at the ends thereof, to sandwich the filter tube between the inner and outer tubes. Where the downhole tubular comprises a plurality of extendable portions, a selected one or ones of the extendable portions may be secured to at least one of the inner and outer tubes.

The provision of an outer tube around the filter tube offers advantages including protecting the filter and extendable portions from damage, for example, through contact with a borehole wall or other downhole tubular or component.

According to a further aspect of the present invention, there is provided an expandable downhole tubular comprising a filter tube having at least one filter portion and at least one extendable portion coupling axial edges of the filter portion, said extendable portion being extendable to accommodate circumferential expansion of said filter tube.

The filter tube may be expandable by exertion of an expansion force directly on the filter tube. Alternatively, the filter tube may be located between inner and outer tubes, and the filter tube may be expandable by expansion of said inner tube. Preferably, the filter tube comprises at least one filter member defining the filter portion and at least one separate extendable member defining the extendable portion and coupled between the axial edges of said filter member.

Further features of the downhole tubular or components thereof are defined above.

In further aspects of the present invention, there are provided expandable downhole tubing strings comprising a plurality of the expandable downhole tubulars defined above.

According to a still further aspect of the present invention, there is provided a method of lining a borehole comprising the steps of:

providing a string of tubing including at least one expandable tubular, said expandable tubular comprising a filter tube including at least one filter portion and at least one extendable portion;

locating the string of tubing in the borehole; and exerting a force on the filter tube to extend the extendable portion and circumferentially extend the expandable tubular.

According to a yet further aspect of the present invention, there is provided a method of recovering well fluid from a borehole, the method comprising the steps of:

providing a string of tubing including at least one expandable tubular, said expandable tubular comprising a filter tube including at least one filter portion and at least one extendable portion;

locating the string of tubing in the borehole; and exerting a force on the filter tube to extend the extendable portion and circumferentially extend the expandable tubular, to provide a flow path for well fluids from surrounding formations through said filter tube to surface, whilst retaining solid particles of a selected size externally of the filter tube.

Preferably, the method further comprises mounting said filter tube over an expandable inner support tube and exerting a force on said inner tube to circumferentially extend the tubular. The inner tube supports and protects the filter tube during handling, running and expansion and of course while the filter tube is subject to pressure forces from the surrounding formation. Preferably also, an expandable outer tube is mounted over the filter tube. The outer tube provides further protection for the filter tube.

One or both of the inner and outer tubes may be provided with a plurality of axially extending slots, whereby circumferentially adjacent slots may be provided axially offset with respect to each other.

The filter tube may be formed by coupling an extendable member defining the at least one extendable portion between axial edges of a filter member defining the at least one filter portion. Preferably, the filter tube is formed by providing a plurality of extendable members and filter members, and coupling each extendable member between axial edges of a pair of adjacent filter members.

The method may further comprise expanding said filter tube using a rotary expansion tool of the type disclosed in the applicant's earlier International patent publication No. WO00/37766 and U.S. Pat. No. 6,457,532.

Most preferably, the method further comprises providing a string comprising a plurality of expandable tubulars and locating said string in the borehole.

The method may comprise providing a filter tube where the filter portion of the filter tube defines more than 50%, and preferably between 50% and 75% or more of a total surface area of the filter tube prior to expansion thereof, and at least 50%, preferably more, perhaps at least 60 or 70% of the total surface area post-expansion.

According to a yet further aspect of the present invention, there is provided a method of manufacturing an expandable downhole tubular, the method comprising the steps of:

providing an expandable support tube;

providing a filter tube comprising at least one extendable portion coupled between axial edges of at least one filter portion; and mounting the filter tube on the support tube.

Preferably, the method further comprises coupling the filter tube to the support tube. The filter tube may be mechanically coupled to the support tube, or may be welded or sintered thereto. The filter tube may describe an unexpanded, first inner diameter no greater than an outer diameter of the support tube, and the filter tube may be partially expanded to a second inner diameter greater than the support tube outer diameter for mounting the filter tube on the support tube. The filter tube may be partially expanded by forcing the filter tube over an expansion member such as a mandrel. Preferably, the filter tube is elastically deformed for mounting on the support tube. Thus the filter tube may elastically recover to grip the support tube when an expansion force exerted on the support tube is released.

Preferably, the method comprises providing a filter tube comprising at least one elastic extendable portion, which may comprise an elastomeric material or a rubber material. As described above, this ensures that a close fit exists between the filter tube and the support tube both prior to and subsequent to expansion, through elastic recovery of the filter tube. This facilitates manufacture of the downhole tubular, as the elasticity of the extendable portion ensures that the filter tube grips the support tube so as to form a close fit there with.

Alternatively, the filter tube may be partially plastically deformed for mounting on the support tube. In a further alternative, the filter tube may be of an inner diameter greater than the outer diameter of the support tube.

The method may further comprise mounting an expandable outer support tube around the filter tube. The expandable outer support tube may be mounted on the filter tube subsequent to mounting of the filter tube on the expandable support tube, which may comprise an inner tube. Alternatively, the expandable outer support tube may be mounted on or around the filter tube during mounting of the filter tube on the expandable, inner support tube. This may be achieved by providing the outer expandable support tube with sufficient elasticity to accommodate elastic deformation of the filter tube during, for example, partial expansion of the filter tube during passage over the expansion member, such as the mandrel.

BRIEF DESCRIPTION OF THE DRAWINGS

There follows a description of embodiments of the present invention, by way of example only, with reference to the accompanying drawings, in which.

DETAILED DESCRIPTION OF THE PREFERRED EMBODIMENT

Figure 1:
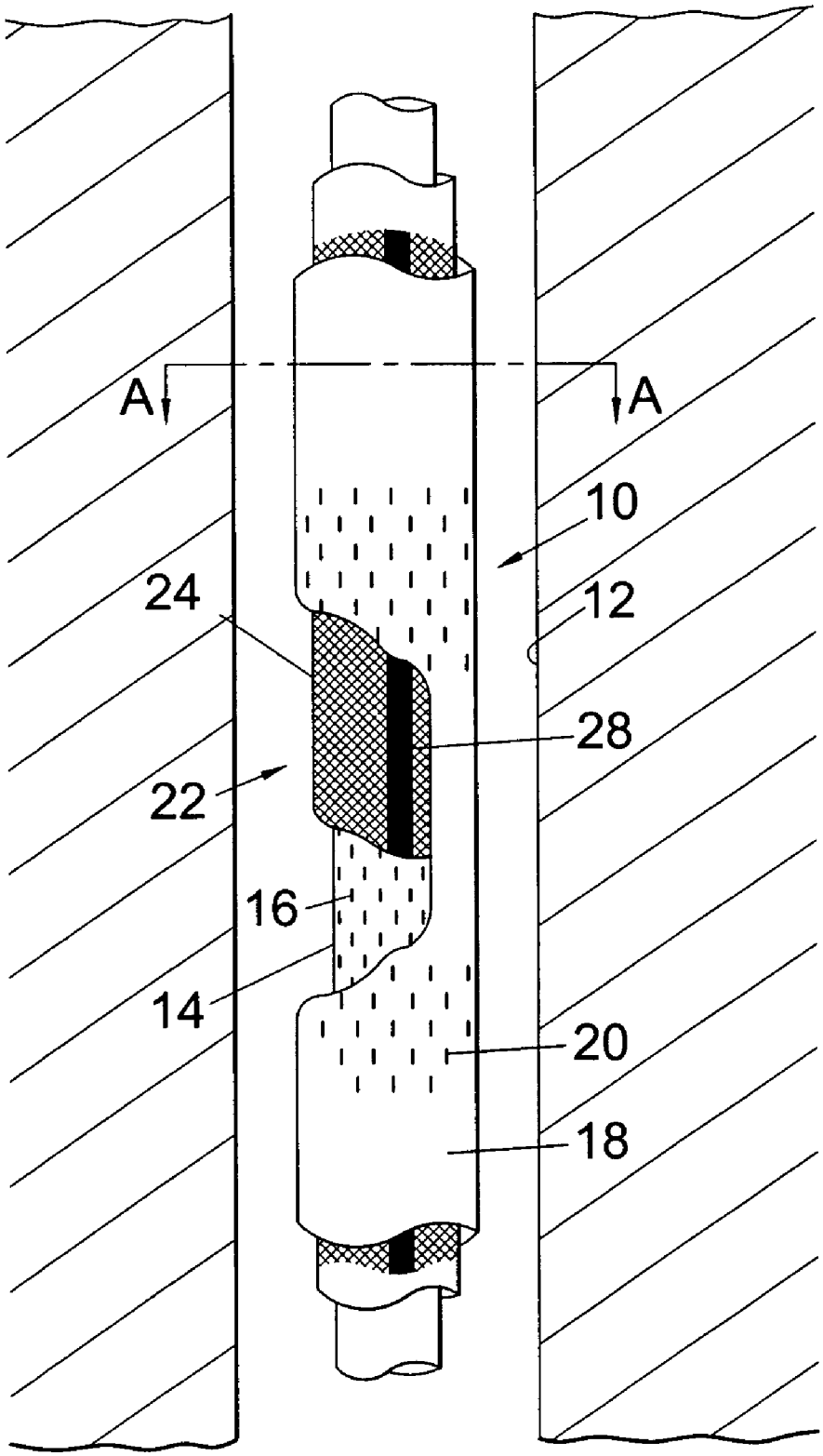
FIG. 1 is a schematic, partially cut-away view of an expandable downhole tubular in accordance with an embodiment of the present invention, shown located in a borehole in an unexpanded configuration.
Figure 2:
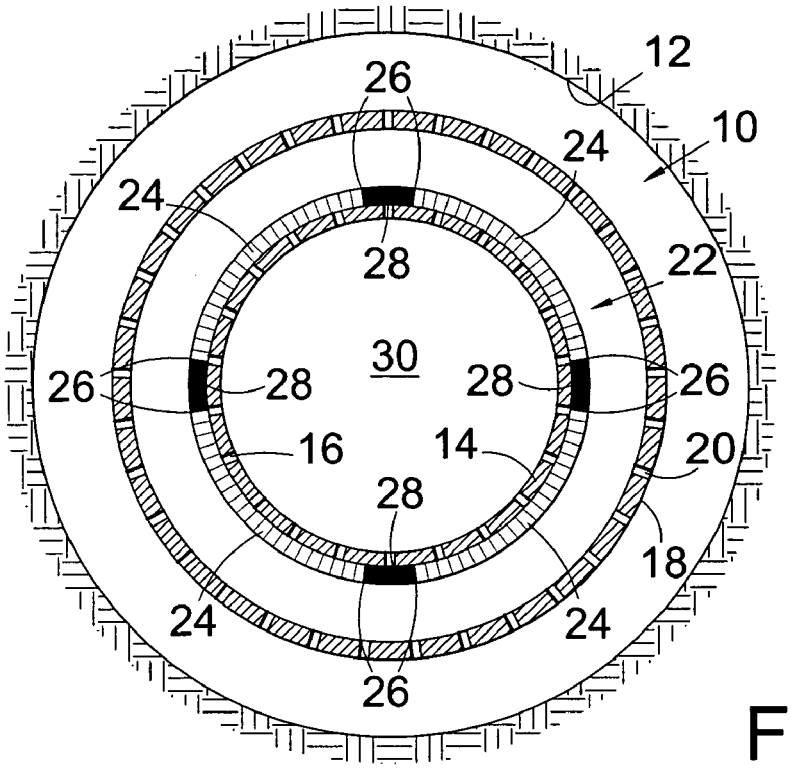
FIG. 2 is a cross-sectional view of the downhole tubular of FIG. 1, taken along line A—A.

Referring firstly to FIG. 1, there is shown a schematic, partially cut-away view of an expandable downhole tubular 10 in accordance with an embodiment of the present invention, shown located in a borehole 12 before expansion of the tubular. FIG. 2 is a cross-sectional view of the tubular 10, taken along line A—A of FIG. 1.

It will be understood that the views of the downhole tubular shown in the Figures are schematic views with certain relative dimensions exaggerated for ease of reference.

The tubular 10 forms part of a string comprising a plurality of such tubulars, which is run into and located in the borehole 12. The borehole 12 is an open hole to be lined by expanding the string of expandable tubulars 10, typically into contact with the bore wall. This has particular uses in bores, which intersect formations in which the formation fluid has a high sand content. However, the tubular 10 has other uses, for example, to line boreholes where the integrity of the formation has deteriorated over time in a previously lined borehole, causing sand to enter the liner. In this situation, the tubular 10 is located within the existing liner and expanded to prevent further sand ingress, whilst permitting well fluid flow. It will be understood that the tubular may be expanded but not necessarily brought into contact with a bore or tubing wall.

The section of tubular 10 shown in FIGS. 1 and 2 includes an inner support tube in the form of a slotted tube 14, which includes machined overlapping slots 16. The tubular 10 also includes an expandable outer tube in the form of a slotted tube 18, which includes similar machined slots 20. The slots 16 and 20 of the inner and outer tubes 14 and 18 are axially extending slots, circumferentially adjacent slots being axially spaced or staggered with respect to each other, as shown in FIG. 1. The slots 16, 20 are arranged to open out to form diamond-shaped openings when the tubular 10 is expanded.

A filter tube 22 is located between the inner and outer tubes 14 and 18, and includes at least one filter portion and at least one extendable portion extending between axial edges of the filter portion. In the embodiment shown, the filter tube 22 includes four filter portions, which comprise filter members in the form of curved filter screens 24, coupled at their axial edges 26 by four extendable members 28, as shown in particular in FIG. 2. The upper and lower ends of the outer tube 18 are welded to the inner tube 14, to provide a secure connection in the finished tubular 10 and to sandwich the filter tube 22 between the inner and outer tubes 14 and 18. The inner tube 14 includes pin and box connections (not shown) at opposite ends, for coupling the tubular 10 to adjacent tubulars.

The filter screens 24 are typically formed of wire mesh with a small mesh size, for filtering fine solid particles such as sand particles from recovered well fluids, to prevent them from entering the borehole 12 and the bore 30 of the tubular 10. The extendable members 28 are each of an elastic material, typically an elastomer, but alternatively a metal or other material, and are extended when the tubular 10 is expanded. As will be described below, forming the extendable members 28 of an elastic material offers numerous advantages including that elastic recovery of the filter tube 22 is greater than that of the inner support tube 14 post expansion, and that the elastic extendable members 28 facilitate manufacture of the expandable tubular 10.

In the unexpanded configuration of the downhole tubular 10 shown in FIG. 2, the filter screens 24 define 75% or more of the total surface area of the filter tube 22. Also, following expansion of the filter tube 22, which will be described below with reference to FIG. 3, the filter screens 24 still define 50% or more of the total surface area of the filter tube 22. In this regard, it will be understood that, as noted above, the Figures are exaggerated illustrations of the downhole tubular of the present invention, and that the filter screens 24 may define significantly more than 50% of the total surface area of the filter tube 22 post expansion. Accordingly, it will be appreciated that the extension of the extendable members 28 has been exaggerated in FIG. 3 for illustration purposes. By maximising total surface area of the filter screens 24, the flow area of the tubular 10 is thereby optimised.

The filter tube 22 is secured to the inner tube 14 in the location of the extendable members 28, typically by welding or sintering the members 28 (depending upon the material) at spot locations, or along an axial line.

When the string of tubulars 10 has been located in the borehole 12, the tubulars are expanded out into contact with the bore wall. This is achieved by running-in an expansion tool, typically a rotary expansion tool such as that disclosed in the applicant's International Patent Publication No. WO00/37766. The expansion tool operates by thinning the wall of the tube 14 and thus circumferentially extends the inner tube 14 to a larger diameter, as shown in the exaggerated view of FIG. 3. This in turn exerts a radial force on the filter tube 22, which is also circumferentially expanded. This circumferential expansion of the filter tube 22 is accommodated by a circumferential extension of the extendable members 28, with minimal, if any, extension of the filter screens 24. Accordingly, the filter screens 24 maintain their structural integrity, and therefore their filtering ability is not impaired or altered by the expansion process. The only deformation, which occurs in the filter screens 24, is that required to accommodate the greater radius of curvature of the filter tube 22.

Figure 3:
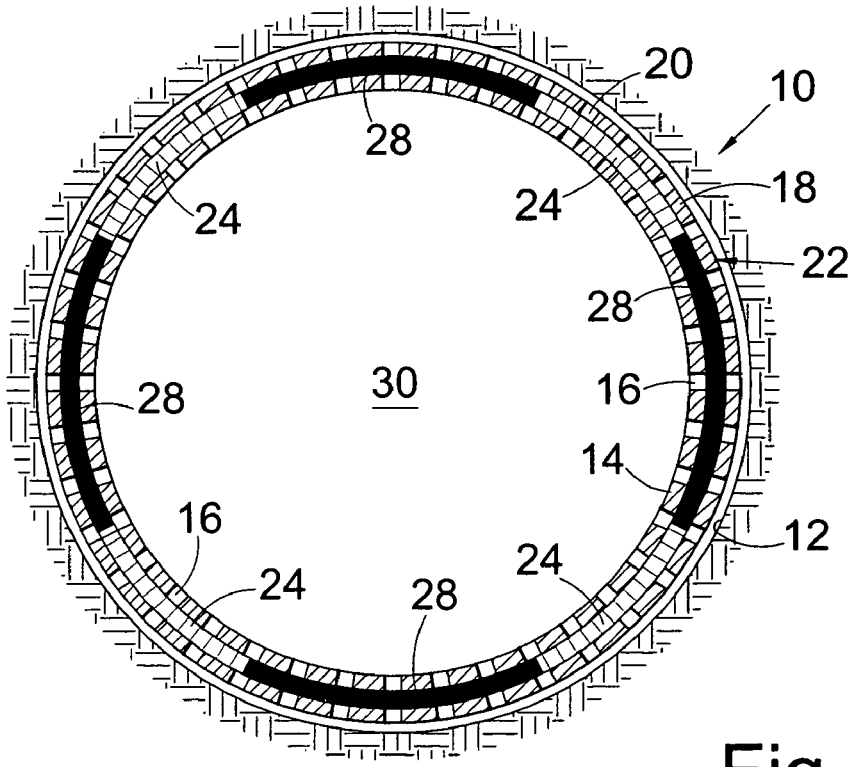
FIG. 3 corresponds to the view of FIG. 2, but shows the tubular in an expanded configuration.

Once the string of tubulars 10 have been fully expanded into contact with the bore wall, as shown in FIG. 3, the tubulars provide a barrier to sand particles entering the bore 30. However, fluid may flow from the formation through the slots 20 in the outer tube 18, the filter screens 24, the slots 16 in the inner tube 14 and into the bore 30, and then to surface.

The tubular 10 is typically constructed by welding or sintering the extendable members 28 to the filter members 24, to form the filter tube 22 with an unexpanded, inner diameter slightly less than the outer diameter of the inner tube 14. The filter tube 22 is then forced over an expansion mandrel (not shown) located adjacent an end of the inner tube 14, which expands the filter tube 22 to a second inner diameter slightly larger than the inner tube outer diameter. This partial expansion is accommodated by elastic extension of the extendable members 28. The partially expanded filter tube 22 is then fed onto the inner tube 14, and the extendable members 28 permitted to elastically contract to bring the filter tube 22 into a close fit around the inner tube 14. The extendable members 28 are then welded or sintered to the inner support tube 14. Finally, the outer tube 18 is located around the filter tube 22 and welded to the ends of the inner tube 14, to sandwich the filter tube 22 between the inner and outer tubes 14, 18.

The tubular 10 of this embodiment of the invention is particularly advantageous over prior art assemblies in that it is relatively quick and easy to manufacture and is anticipated to be reliable in use due, inter alia, to its simplicity.

Various modifications may be made to the foregoing within the scope of the present invention.

For example, any appropriate number of filter portions or members and corresponding extendable portions or members may be employed. The filter tube may be one-piece and the extendable portions may be areas of lower yield strength relative to the filter portions. The filter member may be of any appropriate material, and may for example be of flexible slotted tubing, or wire mesh. Similarly, the extendable member may comprise any suitable plastics material, an elastic woven material, a metal material such as a metal mesh or any other suitable material. Furthermore, the extendable member may alternatively comprise a plastically deformable member.

The above described embodiment features extendable members, which extend parallel to the main axis of the tubular. However, in other embodiments the extendable members may be inclined, for example the extendable members may be helical or otherwise comprise a circumferential component.

Alternative methods may be employed for expanding the tubular, for example by forcing an expander cone through the tubular. Also, the filter tube may be partially plastically deformed during fitting to the inner tube, or the filter tube may be of a larger inner diameter than the outer diameter of the inner tube.

Slots or perforations formed in the inner and/or outer tubes may extend helically or circumferentially with respect to the tube. The extendable portion may be welded along a central axis, or an axial edge thereof. Where the downhole tubular comprises a plurality of extendable portions, a selected one or ones of the extendable portions may be secured to at least one of the inner and outer tubes.

The provision of an outer tube around the filter tube offers advantages including protecting the filter and extendable portions from damage, for example, through contact with a borehole wall or other downhole tubular or component.

The invention claimed is:

1. An expandable downhole tubular comprising:

an expandable inner support tube;

an expandable outer tube; and a filter tube located between said inner support tube and said outer tube, the filter tube comprising at least one filter portion and at least one extendable portion coupling longitudinal axial edges of said filter portion, said extendable portion being elastically extendable to accommodate circumferential expansion of said filter tube and retain elasticity to keep the filter tube in circumferential contact with the inner support tube.

2. An expandable downhole tubular as claimed in claim 1, wherein the tubular comprises a sandscreen for filtering sand particles from well fluids recovered through said outer tube.

3. An expandable downhole tubular as claimed in claim 1, wherein the filter tube comprises at least one filter member defining the filter portion and at least one extendable member defining the extendable portion and coupled between axial edges of said filter member.

4. An expandable downhole tubular as claimed in claim 3, wherein the filter tube comprises a plurality of filter members and a plurality of extendable members.

5. An expandable downhole tubular as claimed in claim 4, wherein each extendable member is coupled between axial edges of an adjacent pair of filter members.

6. An expandable downhole tubular as claimed in claim 1, wherein the filter portion comprises a curved filter screen.

7. An expandable downhole tubular as claimed in claim 1, wherein the filter portion has a higher yield strength than the extendable portion.

8. An expandable downhole tubular as claimed in claim 1, wherein the extendable portion comprises an elastomeric member.

9. An expandable downhole tubular as claimed in claim 1, wherein the extendable portion comprises a rubber member.

10. An expandable downhole tubular as claimed in claim 1, wherein the extendable portion comprises a plastically deformable member.

11. An expandable downhole tubular as claimed in claim 1, wherein the filter tube comprises a one-piece member.

12. An expandable downhole tubular as claimed in claim 1, wherein the filter tube is secured to at least one of said inner and outer tubes to locate the filter tube in the tubular.

13. An expandable downhole tubular as claimed in claim 12, wherein the filter tube is secured by connecting said extendable member to said inner tube.

14. An expandable downhole tubular as claimed in claim 12, wherein part of the extendable member is welded to at least one of the inner and outer tubes.

15. An expandable downhole tubular as claimed in claim 1, wherein the outer tube is coupled to the inner tube to sandwich the filter tube between the inner and outer tubes.

16. An expandable downhole tubular as claimed in claim 1, wherein the inner and outer tubes each include a plurality of axially extending slots.

17. An expandable downhole tubular as claimed in claim 16, wherein the slots of the respective inner and outer tubes are axially spaced.

18. An expandable down hole tubular as claimed in claim 1, wherein in an unexpanded configuration, the filter portion of the filter tube defines at least 50% of a total surface area of the filter tube.

19. An expandable downhole tubular as claimed in claim 18, wherein in the unexpanded configuration, the filter portion of the filter tube defines greater than 75% of a total surface area of the filter tube.

20. An expandable downhole tubular as claimed in claim 1, wherein in an unexpanded configuration, the filter portion of the filter tube defines between 50% and 75% of a total surface area of the filter tube.

21. An expanded downhole tubular as claimed in claim 1, wherein in an expanded configuration, the filter portion of the filter tube defines at least 50% of a total surface area of the filter tube.

22. An expanded downhole tubular as claimed in claim 21, wherein in the expanded configuration, the filter portion of the filter tube defines at least 75% of a total surface area of the filter tube.

23. An expanded downhole tubular as claimed in claim 1, wherein in an expanded configuration, the filter portion of the filter tube defines between 50% and 75% of a total surface area of the filter tube.

24. An expandable downhole tubing string comprising a plurality of expandable downhole tubulars as claimed in claim 1.

25. A method of lining a borehole comprising the steps of:

providing a string of tubing including at least one expandable tubular, said expandable tubular comprising a filter tube including at least one filter portion and at least one extendable portion disposed in a circumference of the filter tube between the at least one filter portion, the filter tube formed by coupling an extendable member defining the at least one extendable portion between axial edges of a filter member defining the at least one filter portion;

locating the string of tubing in the borehole; and exerting a force on the filter tube to elastically extend the extendable portion and circumferentially expand the expandable tubular such that the filter tube remains in circumferential contact with the expandable tubular after expansion thereof.

26. A method as claimed in claim 25, further comprising mounting said filter tube over an expandable inner support tube and exerting a force on said inner tube to circumferentially expand the tubular.

27. A method as claimed in claim 25, further comprising mounting an expandable outer tube over the filter tube.

28. A method as claimed in claim 25, wherein the filter tube is formed by providing a plurality of extendable members and filter members, and coupling each extendable member between axial edges of a pair of adjacent filter members.

29. A method as claimed in claim 25, further comprising expanding said filter tube using a rotary expansion tool.

30. A method as claimed in claim 25, further comprising providing a string comprising a plurality of expandable tubulars and locating said string in the borehole.

31. A method as claimed in claim 25, comprising coupling the extendable portion of the filter tube to at least one of an expandable inner support tube on which the filter tube is mounted and an expandable outer support tube located around the filter tube.

32. A method as claimed in claim 31, comprising welding part of the extendable portion to the inner support tube.

33. A method as claimed in claim 31, comprising providing a plurality of axially extending slots in the inner and outer tubes.

34. A method as claimed in claim 25, comprising providing a filter tube where the filter portion defines at least 50% of a total surface area of the filter tube prior to expansion thereof.

35. A method as claimed in claim 25, comprising expanding the filter tube such that the filter portion defines at least 50% of a total surface area of the filter tube.

36. A method as claimed in claim 25, comprising elastically extending the extendable portion on expansion of the filter tube.

37. A method of manufacturing an expandable downhole tubular, the method comprising the steps of:

providing an expandable support tube;

providing a filter tube comprising at least one extendable portion coupled between longitudinal axial edges of at least one filter portion;

expanding the filter tube to an inner diameter greater than an outer diameter of the support tube for mounting the filter tube on the support tube; and mounting the filter tube on the support tube after expanding the filter tube.

38. A method as claimed in claim 37, further comprising connecting the filter tube to the support tube.

39. A method as claimed in claim 37, wherein the filter tube is expanded by forcing the filter tube over an expansion member.

40. A method as claimed in claim 39, further comprising providing a filter tube of an inner diameter greater than an outer diameter of the support tube.

41. A method as claimed in claim 37, further comprising elastically deforming the filter tube for mounting on the support tube.

42. A method as claimed in claim 37, comprising elastically extending the extendable portion of the filter tube during mounting of the filter tube on the support tube.

43. A method as claimed in claim 37, further comprising plastically deforming the filter tube for mounting on the support tube.

44. An expandable downhole tubular comprising:

an expandable inner support tube;

an expandable outer tube; and a filter tube located between said inner support tube and said outer tube, the filter tube comprising at least one filter portion and at least one extendable portion coupling axial edges of said filter portion, said extendable portion being extendable to accommodate circumferential expansion of said filter tube, wherein the filter tube is secured to said inner support tube by connecting said extendable member to said inner support tube to locate the filter tube in the tubular.

* * * * *